US005390908A

United States Patent [19]

Luxem

[11] Patent Number: 5,390,908

[45] Date of Patent: Feb. 21, 1995

[54] DEVICE AND METHOD FOR DETECTING AND GRIPPING SHEETS

[75] Inventor: Heiner Luxem, Wilhelmsfeld, Germany

[73] Assignee: Heidelberger Druckmaschinen AG, Heidelberg, Germany

[21] Appl. No.: 84,343

[22] Filed: Jun. 28, 1993

[30] Foreign Application Priority Data

Jul. 1, 1992 [DE] Germany ..... 4221578

[51] Int. Cl.[6] ..... B65H 9/04

[52] U.S. Cl. ..... 271/247; 271/265; 271/268

[58] Field of Search ..... 271/245, 246, 247, 268, 271/85, 265, 227; 101/408, 409

[56] References Cited

U.S. PATENT DOCUMENTS

| | | | |
|---|---|---|---|
| 1,984,588 | 12/1934 | Liebusch | 271/247 |
| 2,926,909 | 3/1960 | Jantzen | 271/268 |
| 3,169,476 | 2/1965 | Fielding . | |
| 3,190,645 | 6/1965 | Reinartz | 271/268 |
| 3,335,662 | 8/1967 | Ritzerfeld | 271/265 |
| 3,948,170 | 4/1976 | Ericsson . | |
| 4,354,673 | 10/1982 | Kuroda . | |
| 4,782,755 | 11/1988 | Grua | 271/268 |
| 5,231,927 | 8/1993 | Pfisterer et al. | 101/409 |
| 5,267,728 | 12/1993 | Simeth | 271/245 |

FOREIGN PATENT DOCUMENTS

| | | | |
|---|---|---|---|
| 835749 | 4/1952 | Germany . | |
| 2315602 | 10/1973 | Germany . | |
| 740372 | 11/1955 | United Kingdom | 271/53 |
| 844397 | 8/1960 | United Kingdom . | |

*Primary Examiner*—H. Grant Skaggs

*Attorney, Agent, or Firm*—Herbert L. Lerner; Laurence A. Greenberg

[57] ABSTRACT

A measurement device for detecting the presence of a sheet is disclosed. A paper sheet processing machine has front lays with stop surfaces at which the leading edges of paper sheets are aligned. The paper sheets are accelerated by pre-grippers to a speed sufficient for transferring the paper sheets to a paper sheet processing unit, such as a transfer drum in a sheet-fed rotary offset printing machine. The measurement device comprises upper and lower sensor members between which a gap is defined. The leading edges of sheets which are aligned at the front lays are disposed within the gap. The upper and lower sensor members forming upper and lower boundaries, respectively, of a scanning region which is defined vertically relative to the plane of the paper sheet. Paper sheets which cross the scanning region between the sensor members and which are aligned along the stop surfaces of the front lays are detected. A method and a corresponding pre-gripper assembly are disclosed as well.

12 Claims, 3 Drawing Sheets

DEVICE AND METHOD FOR DETECTING AND GRIPPING SHEETS

BACKGROUND OF THE INVENTION

1. Field of the Invention

The invention relates to a measurement device for detecting and gripping sheets in a region of the front lays of a paper sheet processing machine with means for accelerating the sheets aligned with their leading edges at the front lays to a higher velocity sufficient for transfer to a paper sheet processing unit. The invention further relates to a method for scanning for the presence of sheets in the region of the front lays of a paper sheet processing machine with means for accelerating the sheets aligned along their leading edges at the front lays to a higher velocity necessary for transfer to a paper sheet processing unit. Finally, the invention relates to a gripper device in paper sheet processing machines, in which paper sheets that are aligned at the front lays along their leading edges are received by grippers and are accelerated by the grippers for transfer to a paper processing unit.

2. Description of the Related Art

It has been known in the art of paper sheet processing machines to entrain paper sheets with pre-grippers after they are aligned along their leading edges at the front lays. The gripper transfers the sheets to receiving devices of a paper processing unit disposed downstream as seen in the transport direction, for instance the clamping bar of an impression cylinder of a sheet-fed rotary offset printing machine. The purpose of the pre-grippers is to accelerate the sheets from an alignment position at the front lays, to a velocity which is adapted to the processing speed of the paper processing unit. In the case of high accuracy requirements in the paper processing unit, it is desirable to keep the acceleration of the sheets as low as possible. On the other hand, the acceleration to very high speeds, for instance in fast sheet-fed rotary offset print, is very much limited due to the spatially limited acceleration path.

The time available for acceleration is further substantially reduced by a reaction time of the system and by a sheet alignment safety time period. The sheet alignment safety time period is the time span which elapses before it is ascertained that a paper sheet is present at the front lays for transfer by the pre-gripper. Such safe alignment has been heretofore determined by means of photo-electric sensor devices disposed upstream and downstream, respectively, of the front lays. The sensor devices are disposed below the transport plane and they scan a large region above the sensor location. The sensors by themselves can thereby only ascertain that some paper sheet is present somewhere in a relatively large area above the sensor. The sensor which is disposed upstream of the front lays can merely determine that a part of a paper sheet is located in the region of the front lay. The upstream sensor cannot detect whether or not it is a paper sheet aligned at the front lays or if it is a paper sheet which has shot over the front lay. Also, in the case of long paper sheets, it may even be a trailing edge of a preceding sheet. Only the second, downstream sensor can deliver necessary information when, after a predetermined time window, it does not register a sheet. The information is whether or not the sheet registered by the first sensor is present in an aligned position and ready for transfer by the pre-grippers. The predetermined time window allocated to the second sensor undesirably limits the sheet length to be processed. Only such a length of paper sheets can be processed which, after the trailing edge of the previous sheet has left the second sensor, allow the second sensor, through the predetermined time window and the time span until the sensor is again covered up by the leading edge of the next sheet delivered by the pre-grippers, to register a non-cover.

Furthermore, the interpretation of the signals of two sensors establishes a delay which is to be subtracted from the time available for the acceleration. The acceleration of the sheets, if made too great, causes detrimental alignment shifts in the paper sheets as well as vibrations and feedback with other machine parts.

SUMMARY OF THE INVENTION

It is accordingly an object of the invention to provide a device and method for detecting and gripping sheets, which overcomes the hereinafore-mentioned disadvantages of the heretofore-known devices of this general type and which lengthens the time period available to the pre-gripper for accelerating the paper sheets from the front lay alignment position to the necessary transfer speed.

With the foregoing and other objects in view there is provided, in accordance with the invention, in a paper sheet processing machine having front lays with stop surfaces for aligning paper sheets at leading edges thereof in a given paper sheet plane, and means for accelerating the papers sheets to a speed sufficient for transferring the paper sheets to a paper sheet processing unit, a measurement device for detecting a sheet in the region of the front lays. The measurement device comprises an upper sensor member and a lower sensor member, the sensor members defining a gap therebetween for receiving paper sheets aligned at the front lays, the upper and lower sensor members forming upper and lower boundaries, respectively, of a sensing region defined perpendicularly relative to the given paper sheet plane, the sensor members being means for detecting paper sheets intersecting the stop surfaces of the front lays.

By limiting the measurement region to a path oriented vertically to the sheet delivery plane which only detects sheet planes intersecting the stop surface of the front lays in their aligned position, it is possible to come to a secure determination with only a single sensor. The single sensor is disposed upstream of the front lay stop surface as seen in the sheet transport direction. The determination is towards whether or not a paper sheet is present in an aligned position and ready for transfer by the means for accelerating, for instance the pre-gripper.

Neither so-called overshots nor the trailing edges of a preceding sheet, even if it reaches into the region above the sensor as seen in the sheet travel direction, influence the measurement result. Both the alignment securing time and the interpretation time can thereby be reduced. The acceleration phase can be initiated much earlier and the acceleration can thereby be reduced. Detrimental alignment shifts due to the acceleration as well as vibrations and feedback with other machine parts due to the acceleration can be substantially reduced.

In accordance with an added feature of the invention, the device includes means for selectively, and cyclically in synchronicity with a sheet deliver frequency, moving at least one of the sensor members between a resting position outside a sheet travel region into a measurement position and back into the resting position.

In accordance with an additional feature of the invention, the paper sheets are supported on a feed table defining a paper sheet level, including means for cyclically pivoting the one sensor member from a region below the paper sheet level for measuring in a counter feed direction into a position above the aligned paper sheet and below any paper sheet whose leading edge is disposed downstream of the front lays as seen in the transport direction, the other sensor member being mounted at a level coinciding with the paper sheet level.

In accordance with a further feature of the invention, the paper sheet processing machine includes a pre-gripper for accelerating a paper sheet, the pre-gripper having a gripper finger for clamping the paper sheet, the upper sensor member being mounted at the gripper finger.

In accordance with again an added feature of the invention, the other sensor member is a photo sensor and the at least one sensor member is a cover plate cooperating with the photo sensor. This feature allows a particularly preferred measurement device, because only one electrically controlled sensor part need be stationarily mounted. The stationary part is easily maintained and electrically controlled.

In accordance with again an additional feature of the invention, the sensor members form a part of a capacitive sensor device. The capacitive sensor system is based on the electromagnetic fact that a change in a dielectric between two capacitor plates, for instance of a parallel plate capacitor, causes a change in the capacitance. The change is detectable via the voltage drop across the plates.

With the above-noted and other objects in view, there is also provided, in accordance with the invention, a method for detecting a sheet in a paper sheet processing machine, in which paper sheets disposed in a sheet transport plane are accelerated from a position in which leading edges of the paper sheets are aligned at a front lay of the paper sheet processing machine to a velocity necessary for a transfer of the sheets to a paper sheet processing unit. The method comprises scanning with sensor means a path intersecting the paper sheet disposed parallel to the sheet transport plane and disposed in alignment at the front lay.

In accordance with again a further feature of the invention, the method comprises scanning a path intersecting the paper sheet transport plane in close proximity to a stop surface of the front lay and substantially perpendicularly to the paper sheet transport plane.

In accordance with yet another feature of the invention, the method comprises cyclically pivoting the sensor means into and out of a position for scanning at a given sheet transport frequency.

In accordance with yet an additional feature of the invention, the method comprises providing a pre-gripper for accelerating the paper sheet from the front lay alignment position to a position for transfer to the paper sheet processing unit, the pre-gripper having a pivotable gripper finger for clamping the paper sheet between the gripper finger and a support surface of the pre-gripper, and detecting a presence of a leading edge of the paper sheet between the gripper finger and the support surface.

With the above-noted and other objects in view, there is further provided, in accordance with the invention, a novel pre-gripper assembly in a paper sheet processing machine having a front lay at which a paper sheet is aligned along a leading edge thereof as seen in a transport direction, a paper sheet processing unit disposed downstream of the front lay as seen in the transport direction, and pre-grippers for accelerating the paper sheet from a front lay alignment position to a velocity necessary for transferring the paper sheet to the paper processing unit. The novel pre-gripper assembly comprises —receiving means for receiving a leading edge of a paper sheet in the pre-gripper assembly, the receiving means defining a receiving area;

—sheet detecting means associated with the pre-gripper for cyclically scanning a region extending perpendicularly relative to the transport direction, —the sheet detecting means being movable into a position for scanning across the receiving area perpendicularly to the transport direction.

In accordance with the invention there is also provided, in a printing machine having a feed table and front lays at which paper sheets are aligned along a leading edge thereof as seen in a transport direction, a transfer cylinder disposed downstream of the front lays as seen in the transport direction, and pre-grippers for accelerating paper sheets from rest in a front lay alignment position to a velocity necessary for transferring the paper sheet to the transfer drum, the improvement which comprises: a pre-gripper assembly including receiving means for receiving a leading edge of a paper sheet in the pre-gripper assembly, the receiving means defining a leading edge receiving area; and sheet detecting means for cyclically scanning within the leading edge receiving area in a direction extending substantially perpendicularly relative to the transport direction.

In accordance with a concomitant feature of the invention, the pre-gripper includes means for cyclically moving the sheet detecting means into the leading edge receiving area for scanning across the area.

The gripper configuration as disclosed herein allows for a very quick transfer by the grippers. Several embodiments are disclosed which are especially advantageous in terms of sheet transport and transfer technology. The devices and the method as disclosed and claimed are particularly simple. The devices are advantageous for production, they are friendly in terms of assembly, they are low in maintenance requirements and they are inexpensive because, with the upper gripper finger of a gripper, an already existent moving part may be used for receiving and accelerating the sheet. The cinematics of the moving parts are thus easily embodied.

Other features which are considered as characteristic for the invention are set forth in the appended claims.

Although the invention is illustrated and described herein as embodied in a method and device for detecting and gripping sheets, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

DESCRIPTION OF THE PREFERRED EMBODIMENTS

Figure 1:
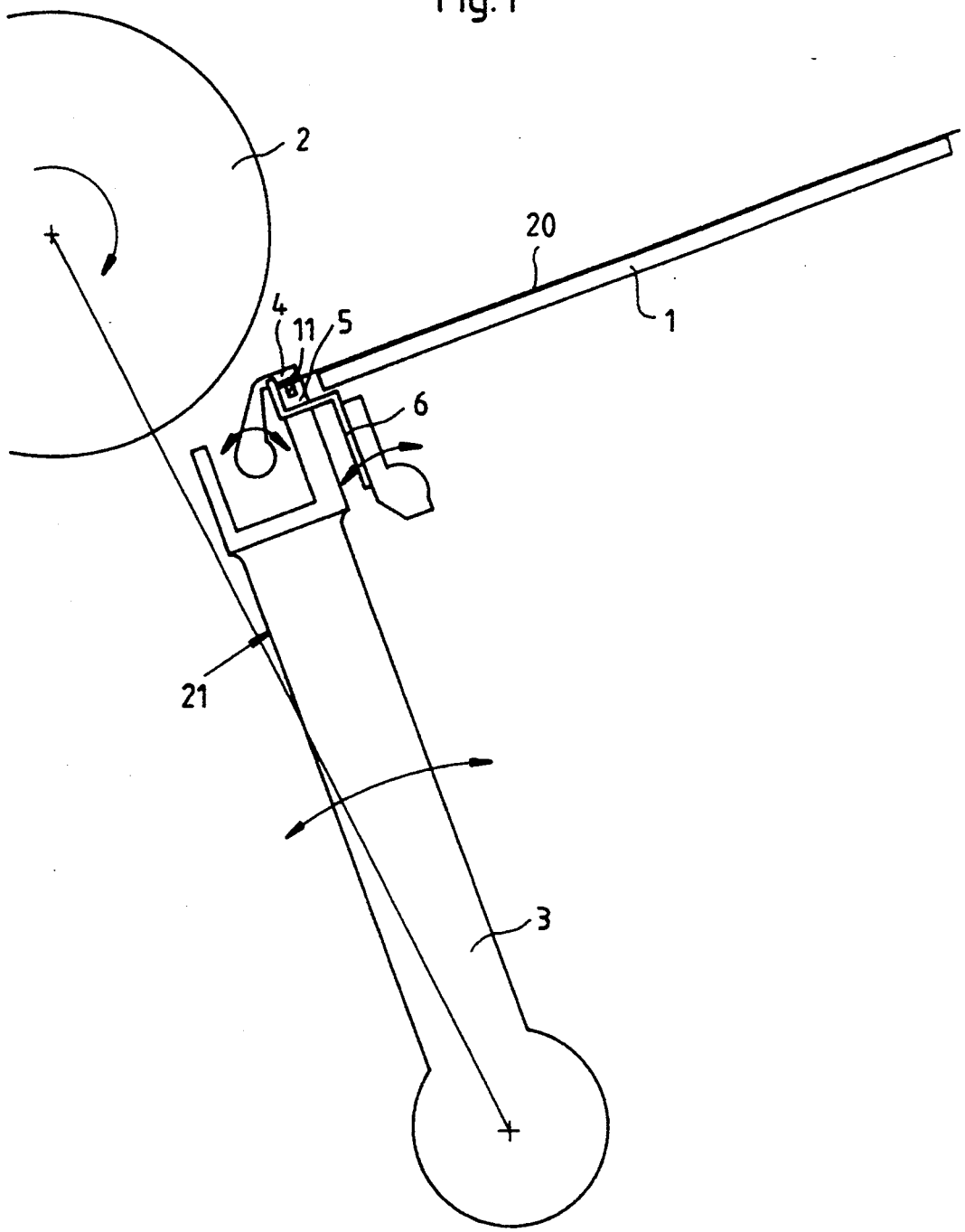
FIG. 1 is a schematic side-elevational view of the configuration according to the invention in a feeder region of a sheet-fed rotary offset printing machine.
Figure 2:
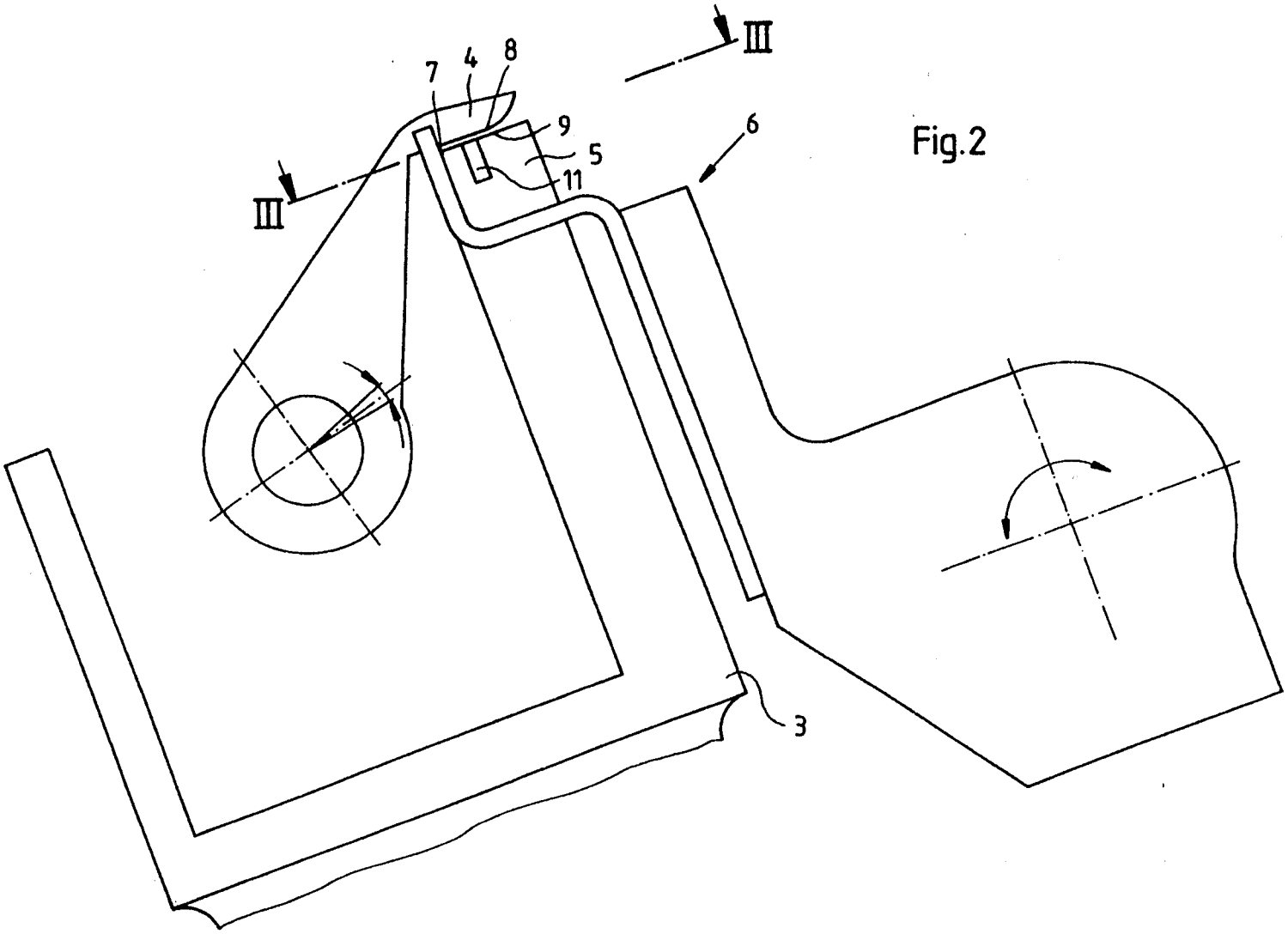
FIG. 2 is an enlarged view of the inventive configuration according to FIG. 1.
Figure 3:
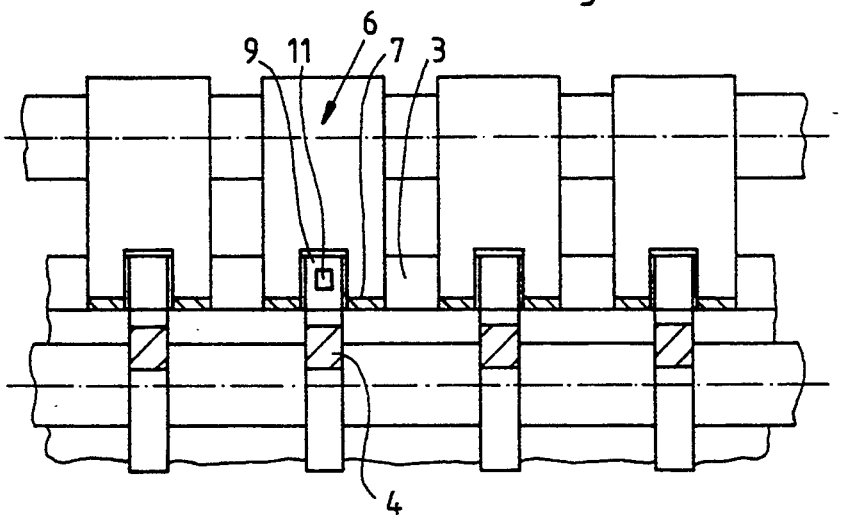
FIG. 3 is a top-plan view of the inventive configuration shown in FIG. 2.

Referring now to the figures of the drawing in detail and first, particularly, to FIG. 1 thereof, there is seen a schematic rendition of a feed table surface of a sheet-fed rotary offset printing machine. A feed table 1 holds paper sheets 20 which are aligned at front guides or front lays 6. The front lays 6 are pivotally mounted in a non-illustrated shaft, which, in turn, is mounted in side frames of the printing machine. The mounting of various shafts and the specific method for aligning the sheets at their leading edges is well known to the person of ordinary skill in this art and is, therefore, not explained in detail in this context. The sheets 20 are aligned at the front lays 6 along their leading edges as seen in a direction of travel. The forward region of the sheet 20 lies on a gripper support 5 of a swing-gripper arm 3 of a pre-gripper. The gripper arm 3 is pivotally mounted in the side frames of the printing machine.

A gripper finger 4 is pivotally mounted on the pivot arm 3 between a waiting position and a measurement position. An eye of a reflection photo sensor 11 or a part of a capacitive sensor device is built into a support surface 9 of the gripper support 5. The photo sensor 11 is aimed vertically upward, such that it covers the gap defined between itself and a lower surface 8 of the gripper finger 4. Due to a difference in degrees of reflection between the lower gripper surface 8 and the paper sheet, the sensor 11 can unambiguously detect whether or not a paper sheet is present between the lower gripper surface 8 and the sensor 11.

The gripper finger 4 is driven such that it deviates from the support surface 9 of the gripper support only within such an angle range that, in a sheet alignment position of the front lay 6 and of the pre-gripper, a stop or alignment surface 7 of the front lay 6 extends across the entire gap.

The operation of the device is such that the paper sheet 20, inserted between the gripper fingers 4 and the gripper support 5, i.e. its support surface 9, is brought to bear against the front lays 6 by the guide means and is aligned therein. As shown in the distance over time diagram of FIG. 4, a linearly rising curve 12 results in this guide region for the movement of the leading edge of the sheet 20. As soon as the leading edge of the sheet crosses the sensor 11 and stops at the stop surface 7 of the front lay 6, the sensor 11 reports the arrival of the sheet after a short sensor reaction time 13. It is clear, in this context, that the control of the device and all computations are processed in the machine control. After a further reaction time for initiating and performing the acceleration, the leading edge of the sheet 20 is accelerated through the time period t 21 up to the point 15 of FIG. 4 and transferred to a transfer cylinder 2 (diagrammatically indicated in FIG. 1). The transfer cylinder 2 is mounted in the non-illustrated side frames of the machine and is driven in a conventional fashion. The transfer cylinder 2 transfers the sheet to a clamping bar in an impression cylinder.

For the transfer, the gripper finger 4 is slightly pivoted away from the pre-gripper support 5. For the next sheet, the front lay 6 and then the pre-gripper arm 3 are pivoted into the alignment position. As soon as the next sheet has been inserted into the gap region between the gripper finger 4 (support surface 8) and the gripper support 5 (support surface 9), the sheets have been aligned at the stop surface 7 of the front lays 6 and have been detected by the sensor 11, the gripper finger 4 is pivoted down onto the aligned sheet 20. The sheet is clamped between the gripper finger 4 and the gripper support 5. After the stop surface 7 of the front lay 6 is pivoted in a counter-clockwise direction to below the level of the feed table 1, the gripper arm 3 again pivots to the transfer cylinder 2 for transferring the clamped sheet.

Figure 4:
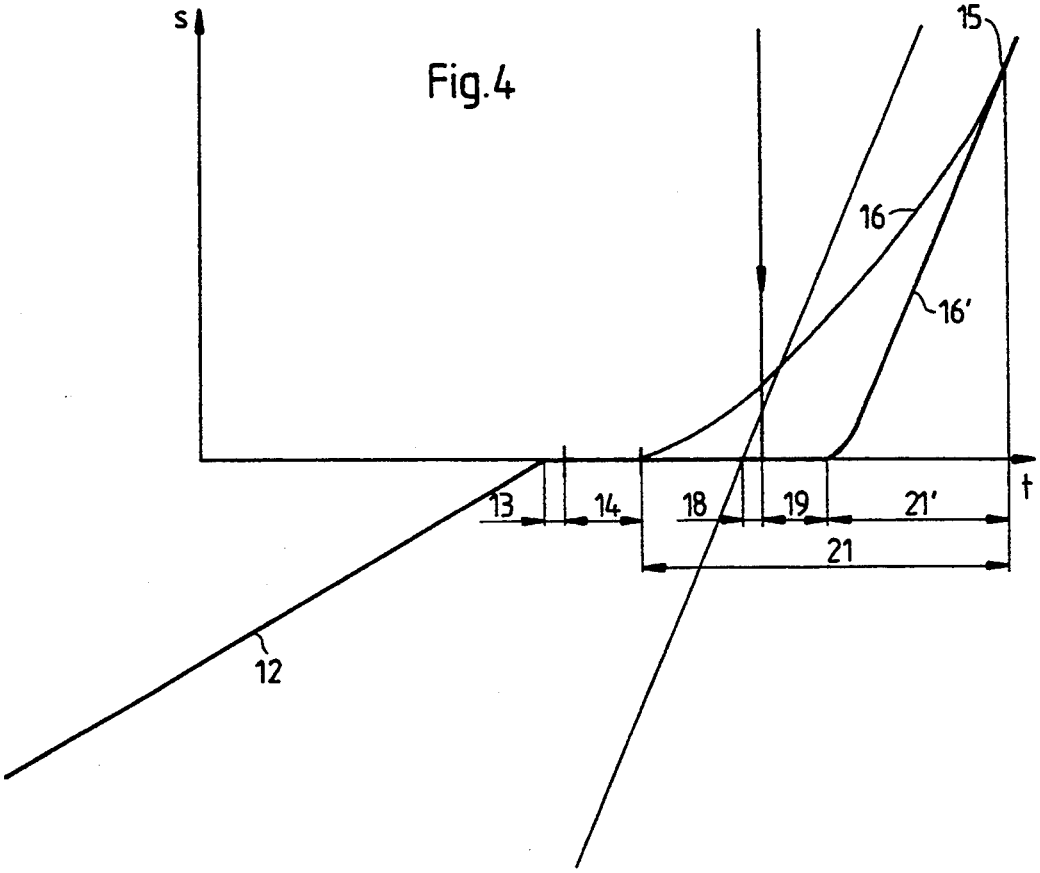
FIG. 4 is a qualitative diagram of distance over time.

Very long paper sheets, i.e. their trailing edges, may still be present in the region of the leading edge alignment location (stop surface 7) when the pre-gripper 3 pivots back into the sheet alignment position. These sheets, however, lie on top of the gripper fingers 4 when the next sheet 20 arrives at the front lays 6. Because they are located outside the path sensed by the sensors 11, they are not detected by the sensors. This makes it possible, as illustrated in FIG. 4, to already initiate the acceleration of the leading edge of an aligned sheet in accordance with an acceleration curve 16, even though the trailing edge of the previous sheet of the curve 17 in FIG. 4 is still present in the effective area of the sensor 11. Because the sensor device only registers sheets located in the gap between the gripper finger 4 and the support 5, in a secure alignment position at the front lays 6, over-shot sheets which travel past the front lay, are also not registered.

It is therefore not necessary at the beginning of the acceleration to first ensure that the trailing edge of the previous sheet is no longer in the effective area of the sensor and then, after a sensor reaction time 18 and a reaction time 19 for the initiation of the acceleration, to initiate the actual acceleration according the acceleration curve 16' (FIG. 4). For the actual acceleration, therefore, not only the period t 21' is available but the substantially longer acceleration period t 21. The acceleration according to the slope of the curve 16 can be substantially less than the acceleration according to the slope of the curve 16'.

It is sufficient for the proper functioning of the device to provide a single sensor eye across the width of the feed table, i.e. to provide a sensor for only one of the several gripper fingers. It is preferable, however, to provide two of the gripper fingers with a sensor each. The two sensors would be disposed symmetrically with respect to the center of the feed table, i.e. to an axis of sheet transport. It is also conceivable, of course, to associate further sensors with further gripper fingers.

I claim:

1. In a paper sheet processing machine having front lays with stop surfaces for aligning paper sheets at leading edges thereof in a given paper sheet plane, and means for accelerating the papers sheets to a speed sufficient for transferring the paper sheets to a paper sheet processing unit, a measurement device for detecting a sheet in the region of the front lays, comprising an upper sensor member and a lower sensor member, said sensor members defining a gap therebetween for receiving paper sheets aligned at the front lays, said upper and lower sensor members forming upper and lower boundaries, respectively, of a sensing region defined perpendicularly relative to said given paper sheet plane, said sensor members being means for detecting paper sheets intersecting the stop surfaces of the front lays, and means for moving at least one of said sensor members between a waiting position outside a sheet travel region into a measurement position and back into the waiting position.

2. The measurement device according to claim 1, wherein said moving means move said at least one sensor member selectively, and cyclically in synchronicity with a sheet deliver frequency.

3. The measurement device according to claim 2, wherein the paper sheets are supported on a feed table defining a paper sheet level, including means for cyclically pivoting said one sensor member from a region below said paper sheet level for measuring in a counter feed direction into a position above the aligned paper sheet and below any paper sheet whose leading edge is disposed downstream of said front lays as seen in the transport direction, said other sensor member being mounted at a level coinciding with said paper sheet level.

4. The measurement device according to claim 3, wherein the paper sheet processing machine includes a pre-gripper for accelerating a paper sheet, the pre-gripper having a gripper finger for clamping the paper sheet, said upper sensor member being mounted at said gripper finger.

5. The measurement device according to claim 3, wherein said other sensor member is a photo sensor and said at least one sensor member is a cover plate cooperating with said photo sensor.

6. The measurement device according to claim 1, wherein said sensor members form a part of a capacitive sensor device.

7. A method for detecting a sheet in a paper sheet processing machine, in which paper sheets disposed in a sheet transport plane are accelerated from a position in which leading edges of the paper sheets are aligned at a front lay of the paper sheet processing machine to a velocity necessary for a transfer of the sheets to a paper sheet processing unit, which comprises:

scanning with sensor means a path intersecting the paper sheet disposed parallel to the sheet transport plane and disposed in alignment at the front lay; and cyclically pivoting a member of the sensor means relative to a sheet transport plane between a waiting position and a position for scanning at a given sheet transport frequency.

8. The method according to claim 7, which comprises scanning a path intersecting the paper sheet transport plane in close proximity to a stop surface of the front lay substantially perpendicularly to the paper sheet transport plane.

9. The method according to claim 7, which comprises providing a pre-gripper for accelerating the paper sheet from the front lay alignment position to a position for transfer to the paper sheet processing unit, the pre-gripper having a pivotable gripper finger for clamping the paper sheet between the gripper finger and a support surface of the pre-gripper, and detecting a presence of a leading edge of the paper sheet between the gripper finger and the support surface.

10. In a paper sheet processing machine having a front lay at which a paper sheet is aligned along a leading edge thereof as seen in a transport direction, a paper sheet processing unit disposed downstream of said front lay as seen in the transport direction, and pre-grippers for accelerating the paper sheet from a front lay alignment position to a velocity necessary for transferring the paper sheet to the paper processing unit, a pre-gripper assembly comprising:

receiving means for receiving a leading edge of a paper sheet in the pre-gripper assembly, said receiving means defining a receiving area;

sheet detecting means associated with the pre-gripper for cyclically scanning a region extending perpendicularly relative to the transport direction, said sheet detecting means having a member being movable into a position for allowing said sheet detecting means to scan across said receiving area perpendicularly to the transport direction.

11. In a printing machine having a feed table and front lays at which paper sheets are aligned along a leading edge thereof as seen in a transport direction, a transfer cylinder disposed downstream of the front lays as seen in the transport direction, and pre-grippers for accelerating paper sheets from rest in a front lay alignment position to a velocity necessary for transferring the paper sheet to the transfer drum, the improvement which comprises:

a pre-gripper assembly including receiving means for receiving a leading edge of a paper sheet in the pre-gripper assembly, said receiving means defining a leading edge receiving area;

sheet detecting means for cyclically scanning within said leading edge receiving area in a direction extending substantially perpendicularly relative to the transport direction; and means for moving a member of said sheet detecting means relative to the front lay alignment position.

12. The pre-gripper according to claim 11, wherein said moving means are means for cyclically moving the member of said sheet detecting means into said leading edge receiving area for scanning across the area.

* * * * *